US006132322A

United States Patent [19]

Bonham

[11] Patent Number: 6,132,322

[45] Date of Patent: Oct. 17, 2000

[54] PERFECT STROKE

[76] Inventor: Ryan James Bonham, 10220 Ashley Farm Dr., Matthews, N.C. 28105

[21] Appl. No.: 09/377,526

[22] Filed: Aug. 19, 1999

[51] Int. Cl.[7] ..... A63B 69/36

[52] U.S. Cl. ..... 473/208; 473/274

[58] Field of Search ..... 473/207, 208, 473/274, 275, 251, 252; 434/252; 482/105

[56] References Cited

U.S. PATENT DOCUMENTS

| | | | |
|---|---|---|---|
| 3,514,106 | 5/1970 | Picotte | 273/81.3 |
| 5,156,401 | 10/1992 | Hodgkiss | 273/186.2 |
| 5,470,073 | 11/1995 | Vasquez | 273/187.2 |
| 5,531,446 | 7/1996 | Scheie et al. | 473/227 |
| 5,569,095 | 10/1996 | McCollum | 473/215 |
| 5,658,203 | 8/1997 | Shub | 473/205 |
| 5,688,184 | 11/1997 | Jonhson | 473/229 |
| 5,890,968 | 4/1999 | Mingo | 473/207 |
| 5,893,803 | 4/1999 | Leadbetter et al. | 473/206 |

*Primary Examiner*—Kien T. Nguyen
*Attorney, Agent, or Firm*—Patent & Trademark Services; Thomas Zack; Joseph H. McGlynn

[57] ABSTRACT

A golfer's putting aid device. The device has an elongated straight pendulum bar and a strap with a pad section. The strap is connected to the bar by a bar guide. The looped flexible strap extends around the neck of a user as well as the depending pendulum bar which rests against the users chest. The pad section is made of a soft foam pad on the strap rest against the back of the neck while an accessible adjustment buckle permits the strap's loop length size to be varied. In use, both straightened arms extends outwardly from the bar away from the chest while the user's hand grasp the handle of the putter and swing the putter in a pendulum type motion.

3 Claims, 2 Drawing Sheets

PERFECT STROKE

BACKGROUND OF THE INVENTION

This invention relates to a golf training aid device to assist a user in achieving the perfect putting stroke.

Most golf instructors teach the sensation of using ones shoulders in a rocking motion to obtain the perfect putting stroke. The present device mimics this rocking motion when properly placed over the user's head with a pendulum bar resting against the chest and both arms outside of the bar all as will be described in detail hereafter.

DESCRIPTION OF THE PRIOR ART

Golf teaching aid devices are well known. For example, in the U.S. Pat. No. 3,514,106 to Picotte discloses a golf club with a pivotal leg engaging crossbar.

U.S. Pat. No. 5,156,401 to Hodgkiss discloses a T-shaped putting training device having a stem secured to the handle end of a golf club shaft. A cross-piece abuts a users chest with its end portions extending behind a users arms.

U.S. Pat. No. 5,470,073 to Vasquez discloses golf instruction device having a cap with a pair of links that have arm pads.

U.S. Pat. No. 5,531,446 to Scheie et al. discloses a golfer's putting aid having an elongated rod with a spherical end member. The rod is slidably inserted through an opening in the end of the putter's grip.

SUMMARY OF THE INVENTION

This invention relates to golfer's putting aid device. This device has an elongated straight pendulum bar and a padded strap connected to the bar by a guide. The strap extends around the neck of a user as the depending pendulum bar rests against the chest of a user.

It is the primary object of the present invention to provide for an improved golf putting training aid device.

Another object is to provide for such a device wherein a pendulum type motion of the held putter is taught when properly used.

These and other objects and advantages of the present invention will become apparent to readers from a consideration of the ensuing description and the accompanying drawings.

DESCRIPTION OF THE PREFERRED EMBODIMENT

Figure 1:
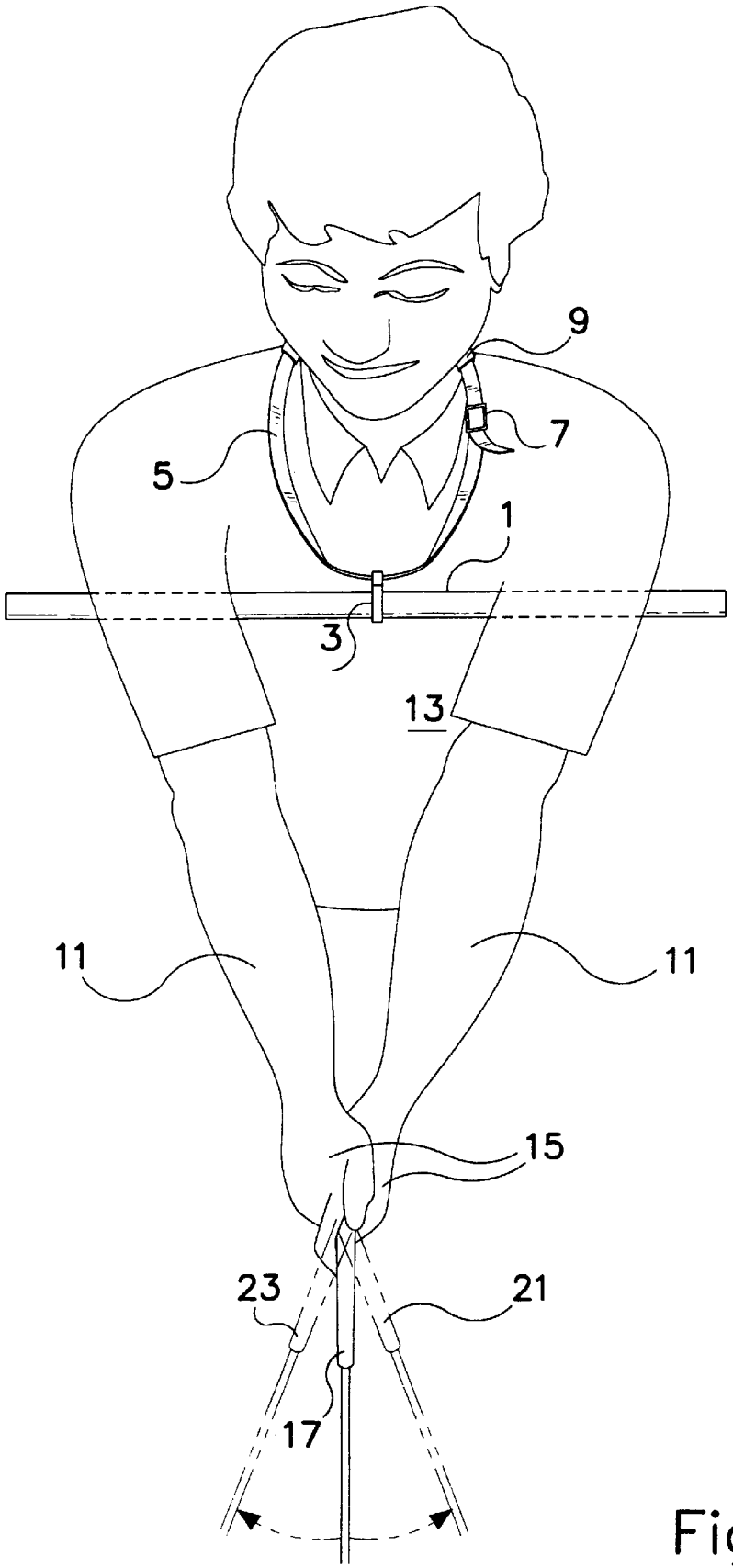
FIG. 1 is a front view of the present invention.

FIG. 1 is a front view of the present invention. The invention consists of the straight pendulum bar 1, the joining guide 3, the looped strap 5 with its buckle 7 and neck engaging pad 9 (partially shown). The elongated pendulum bar 1 (or bar) fits under the upper portions of the users arms

Figure 4:
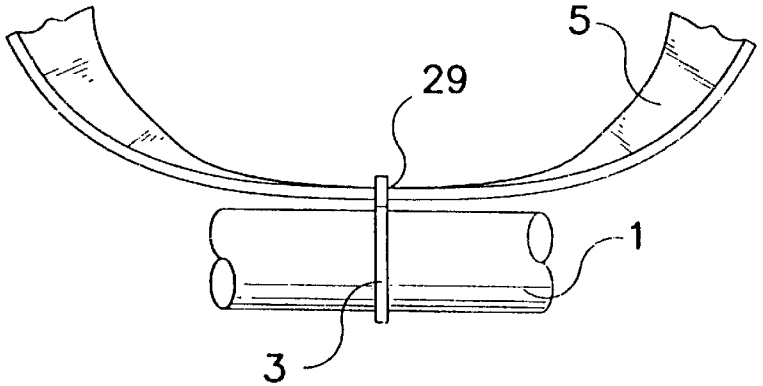
FIG. 4 is a front view showing the bar guide joining the strap to the pendulum bar.

11 just under the arm pits. Extending in a generally horizontally disposed direction, the bar rests against the user's chest 13 while their outstretched straight arms are extend forward from the chest and away from the user's torso. Joining the generally rigid bar 1 to the flexible looped strap 5 is a ba guide 3. As shown in more detail in FIGS. 3 and 4, the bar guide has two sections each of which are fixed together. One of these guide sections is fixed to the bar 1 and the other section is mounted on the strap 5 along its length. A strap buckle 7 joins the ends of the strap together and permits the lengthwise adjustment of the looped strap. This adjustment allows the bar to be raised or lower to serve a large variety of different sized users and to allow for the comfortable proper resting of the bar against the chest of a user. The strap pad 9 is fixed to the strap and engages the rear portion of a user's neck to provide for a comfortable fit during putting practice.

With both arms extended in a straight somewhat locked position, the user's hands 15 are wrapped around the handle end 17 of the putter 19, whose upper shaft end is shown. As the use moves its outstretched arms in a pendulum type motion, the held putter and is attached lower end putter head (not shown) will move in a similar pendulum type motion. The right side dotted line position 21 of the putter's handle and the left side dotted line position 23 represent the approximate locations the swung putter handle 17 would take when going through the pendulum swinging motion.

Figure 2:
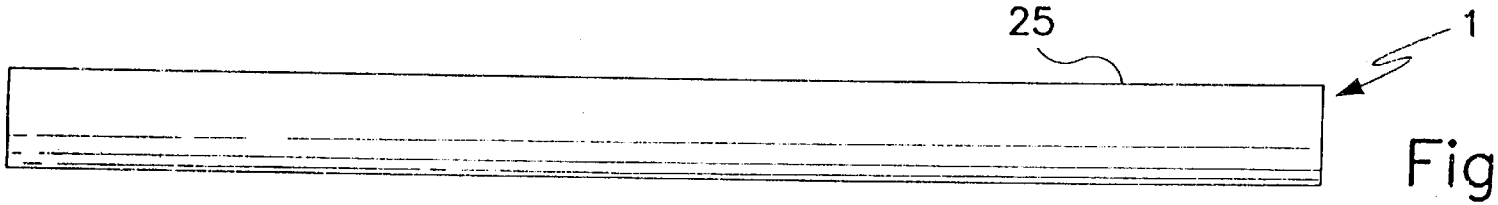
FIG. 2 is a front view of the pendulum bar shown in FIG. 1.

FIG. 2 is a front view of the pendulum bar 1 shown in FIG. 1. The inner rod core of the straight bar is made of a rigid material such as semi-hard plastic material. Surrounding this rod core is an encasing soft foam material 25 to provide for comfort when the bar is resting against a user's chest.

Figure 3:
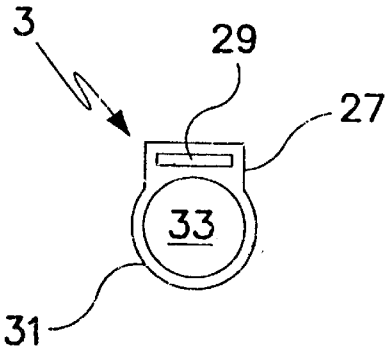
FIG. 3 is a side view of the bar guide used with the invention.

FIG. 3 is a side view of the bar guide 3 used with the invention. This guide has two joined sections the upper one 27 of which has a small hole 29 used to slidable receive the strap 5 along the strap's length. The lower guide ringed shaped section 31 is complementarily shaped to fit around the cross section of the cylindrically shaped bar 1 and retain the bar in position relative to the guide. A center hole 33 receives the bar 1 about midway of its total length and is fixedly joined to the bar. As shown in the FIG. 4 front view, the guide 3 joins the strap to the bar and permits some very slight movement of the bar relative to the flexible strap at its upper guide hole 29 connection when the user moves their arms.

Figure 5:
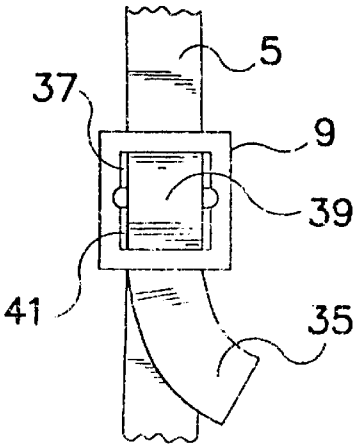
FIG. 5 is a front view of the adjustable strap buckle.

FIG. 5 is a front view of the adjustable strap buckle 9. This conventional buckle allows the looped strap to have its length changed by placing the free strap end 35, which is shown extending from the buckle, at a different locations. As is conventional, the strap end is fitted under one of the buckle's holed opening 37 then over the buckle's center member 39 and through the lower buckle opening 41. By pulling on the free end 35, the strap's looped length may lessened while movement of the strap in the opposite direction allows for a larger strap looped length.

Figure 6:
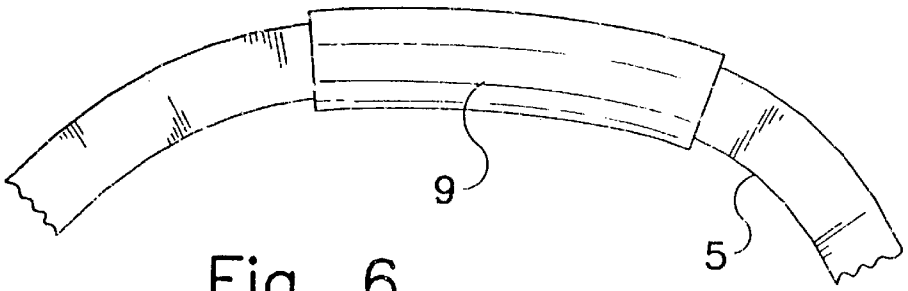
FIG. 6 is an enlarged front view of the strap pad.

FIG. 6 is an enlarged front view of the strap pad 9. This soft foam pad, like foam rubber or plastic foam material, fits around and is fixed to the strap section which engages the back portion of a user's neck to provide a comfortable engagement in use. Normally, the pad's total length is greater than the length of the strap section engaged by the user's neck to allow for the strap's use with different neck sized users as the buckle 9 adjusts the loop length of the strap.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A putting aid device comprising:

a looped flexible strap adapted to be wrapped around the neck of a user;

an elongated generally straight pendulum bar;

means for attaching the strap along the strap's length to the pendulum bar, said means for attaching the strap including a bar guide extending around the pendulum bar and fixedly mounted to the bar and a section having an aperture adapted to engage the strap along the strap's length in a slidable manner; and a strap length adjustment buckle mounted on the strap along the length of the strap.

2. The putting aid device as claimed in claim 1, also including a pad fixed to the strap along a section of the strap's length, said pad being adapted to engage the rear neck portion of a user when supporting the bar.

3. The putting aid device as claimed in claim 2, wherein said pad is made of a soft foam material which encases the section of the strap's length that engages the neck of a user.

* * * * *